US009303381B2

(12) United States Patent
Balogh

(10) Patent No.: US 9,303,381 B2
(45) Date of Patent: Apr. 5, 2016

(54) HANDHOLE AND MANHOLE ANTI-THEFT INSERT

(71) Applicant: John E Balogh, Grosse Ile, MI (US)

(72) Inventor: John E Balogh, Grosse Ile, MI (US)

( * ) Notice: Subject to any disclaimer, the term of this patent is extended or adjusted under 35 U.S.C. 154(b) by 0 days.

(21) Appl. No.: 14/576,651

(22) Filed: Dec. 19, 2014

(65) Prior Publication Data

US 2016/0032552 A1 Feb. 4, 2016

Related U.S. Application Data

(60) Provisional application No. 61/913,843, filed on Dec. 9, 2013.

(51) Int. Cl.
*E02D 29/14* (2006.01)

(52) U.S. Cl.
CPC ..... *E02D 29/1427* (2013.01); *E02D 29/1481* (2013.01)

(58) Field of Classification Search
CPC ..... E02D 29/1427; E02D 29/1481
USPC ..... 404/25; 52/19
See application file for complete search history.

(56) References Cited

U.S. PATENT DOCUMENTS

| | | | | |
|---|---|---|---|---|
| 3,968,601 | A | 7/1976 | Brown et al. | |
| 4,013,374 | A * | 3/1977 | Weiler | E02D 29/14 404/25 |
| 4,662,777 | A * | 5/1987 | Newton | E02D 29/124 404/25 |
| 5,123,776 | A * | 6/1992 | Lang | E02D 29/14 404/25 |
| 5,458,435 | A * | 10/1995 | Kohno | B66F 19/005 404/25 |
| 6,204,446 | B1 | 3/2001 | Parduhn | |
| 6,688,806 | B2 | 2/2004 | Kuan | |
| 6,833,505 | B1 | 12/2004 | Macchietto | |
| 7,157,642 | B2 | 1/2007 | Bowmam et al. | |
| 7,896,574 | B2 | 3/2011 | Nolle et al. | |
| 2009/0290934 | A1 * | 11/2009 | Jordan | E02D 29/14 404/26 |
| 2013/0011194 | A1 * | 1/2013 | Lorenz | E02D 29/14 404/25 |

* cited by examiner

*Primary Examiner* — Raymond W Addie
(74) *Attorney, Agent, or Firm* — Mastrogiacomo PLLC

(57) ABSTRACT

An anti-theft insert capable of preventing unauthorized access to a handhole and manhole and preventing the theft of the internal components of the handhole and manhole, the anti-theft insert comprises a cap, the cap including a chamfer and a top surface, a post member, the post member including a keyway, and at least one anchor point. The post member is configured to support the cap. An outer diameter of the cap is sized to fit within an inner diameter of the handhole and manhole. The weight of the anti-theft device is of a sufficient amount so as to prevent the unauthorized removal of the anti-theft device from the handhole and manhole.

18 Claims, 14 Drawing Sheets

HANDHOLE AND MANHOLE ANTI-THEFT INSERT

CROSS REFERENCE TO RELATED APPLICATIONS

This patent application claims the benefit of priority based on U.S. Provisional Patent Application No. 61/913,843 filed on Dec. 9, 2013, which is incorporated by reference in its entirety for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to handhole and manhole anti-theft inserts and, more particularly, to a handhole and manhole anti-theft insert capable of securing the contents of a handhole and manhole.

2. Background Art

Handholes as well as manholes have been used for several years to provide workers access to a myriad of underground utilities such as pipes that carry water from a source to a destination and conduit that house wiring and fiber optic cable for the distribution of electricity, cable television, internet access, telephone service and the like. While pipes for water and other liquids have been traditionally buried underground, municipalities have only recently been burying other utilities such as electrical wiring, telephone lines, cable, fiber optic cable and the like underground rather than raised above the ground and secured to utility poles.

Handholes and manholes are strategically placed along the routes of the underground utilities described above to allow workers to gain underground access to the utilities without having to disturb or excavate the earth above or around the utilities. Providing access to utilities through handholes and manholes saves time and expense if access is required for the maintenance, repair or update of the underground utilities. While these handholes or manholes allow workers to easily access the underground utilities, they also provide easy access for those individuals seeking to commit illegal acts. For example, removing commodities such as copper pipe and wire that can be sold for scrap and disrupting utilities by destroying electrical or cable television connections.

Although handhole and manhole covers are often designed and manufactured to be extremely heavy, individuals can, nonetheless, easily remove the covers to gain access to the underground utilities. There are several prior art patents (such as U.S. Pat. No. 7,896,574 issued to Nolle et al.) that disclose adding a locking mechanism to the handhole or manhole cover to secure and lock the cover to a frame. This locking mechanism only deters would be criminals momentarily. While the cover cannot generally be removed from the frame due to the lock, the frame can be easily removed from the concrete base of the handhole or manhole thereby allowing access to the interior of the handhole or manhole.

Therefore, a need exist for a handhole and manhole anti-theft insert that will prevent the unauthorized access of underground utilities through a handhole and manhole even after the cover and frame have been removed from the concrete base of the handhole and manhole.

BRIEF SUMMARY OF THE INVENTION

An anti-theft insert capable of preventing unauthorized access to a handhole and manhole and preventing the theft of the internal components of the handhole and manhole is provided. The anti-theft insert comprises a cap, the cap including a chamfer and a top surface, a post member, the post member including a keyway, and at least one anchor point. The post member is configured to support the cap. An outer diameter of the cap is sized to fit within an inner diameter of the handhole and manhole. The weight of the anti-theft device is of a sufficient amount so as to prevent the unauthorized removal of the anti-theft device from the handhole and manhole.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
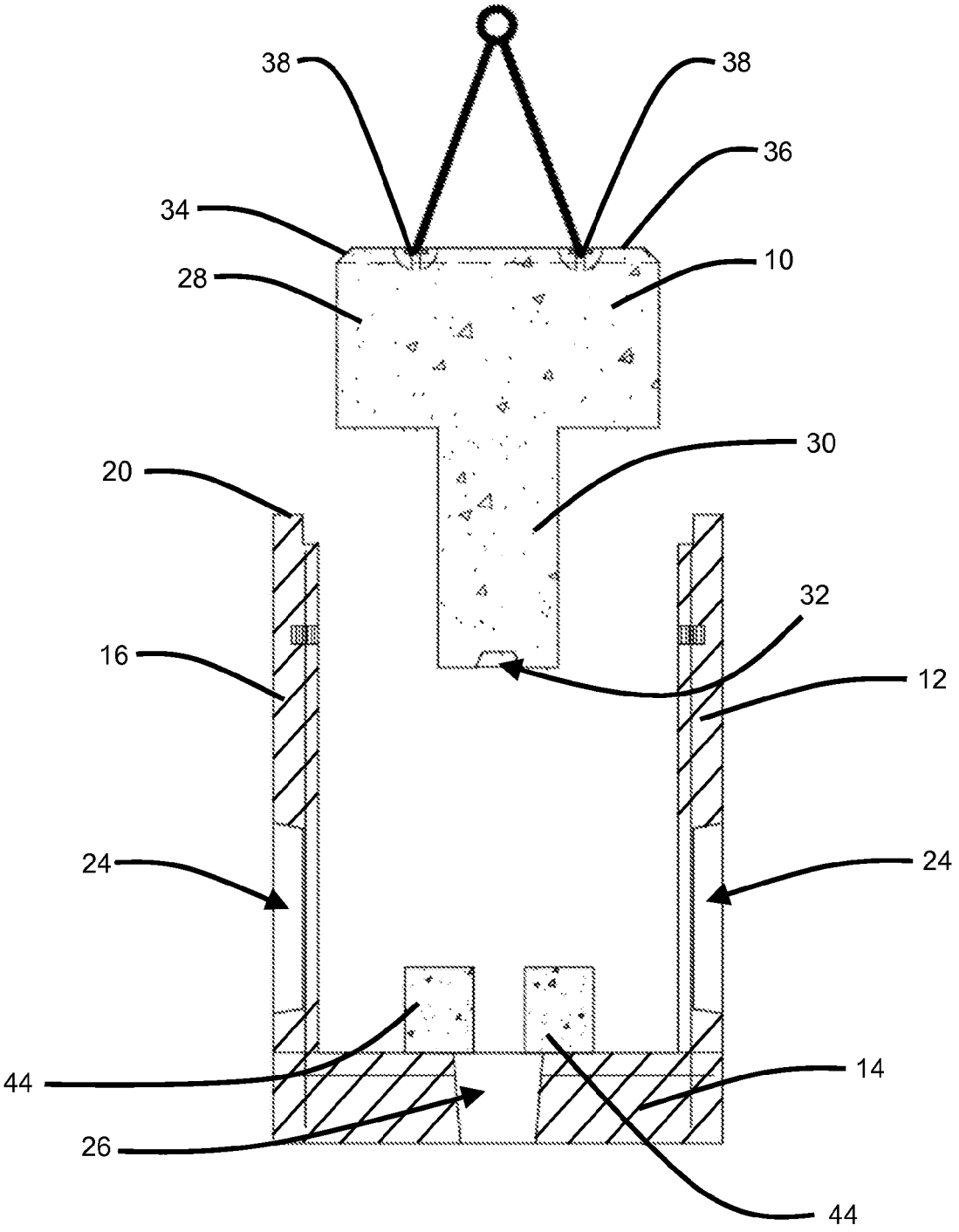
FIG. 1 is a cross-sectional view of a handhole anti-theft insert according to an embodiment of the present invention.
Figure 2:
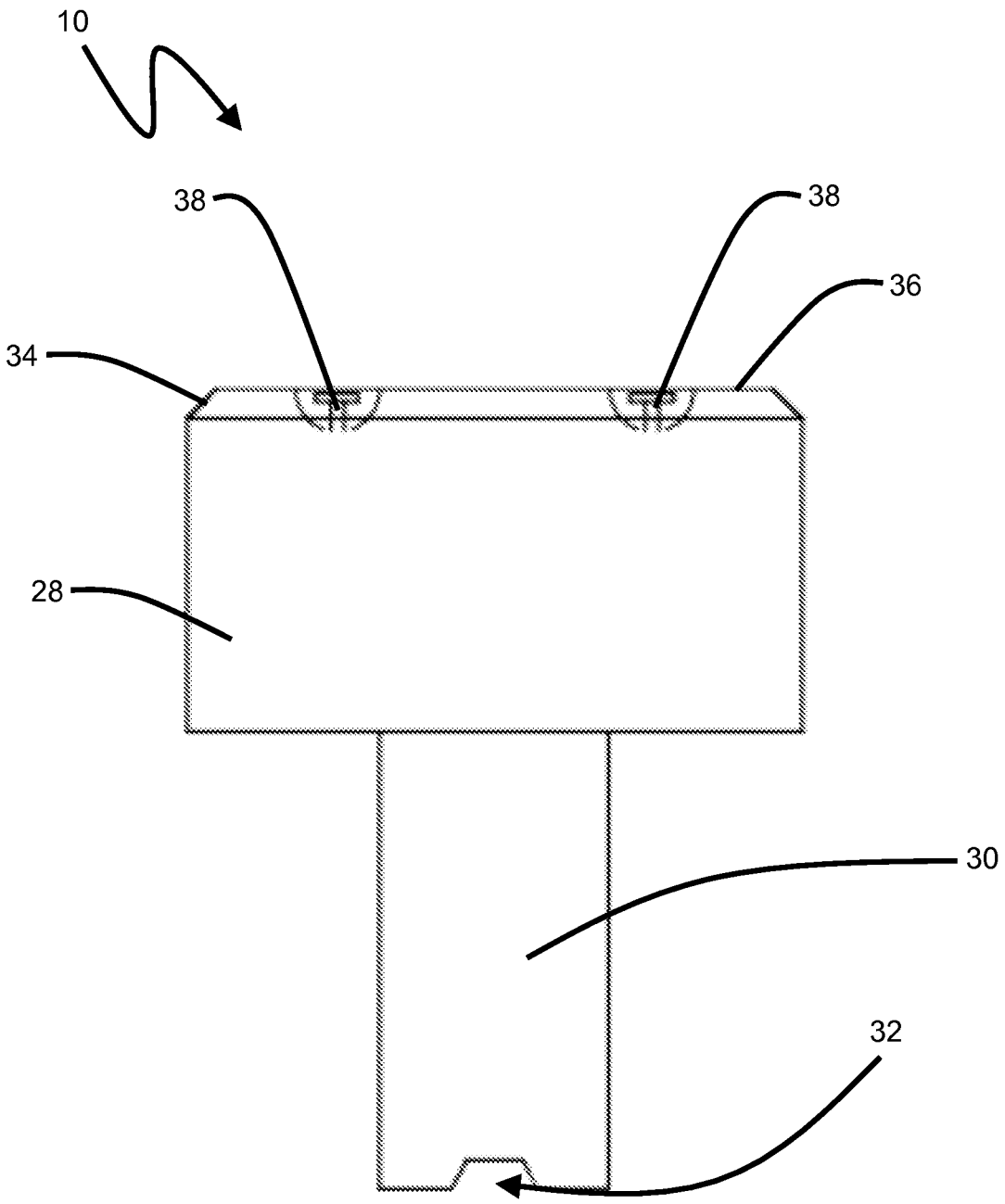
FIG. 2 is a side view of a handhole anti-theft insert according to an embodiment of the present invention.
Figure 3:
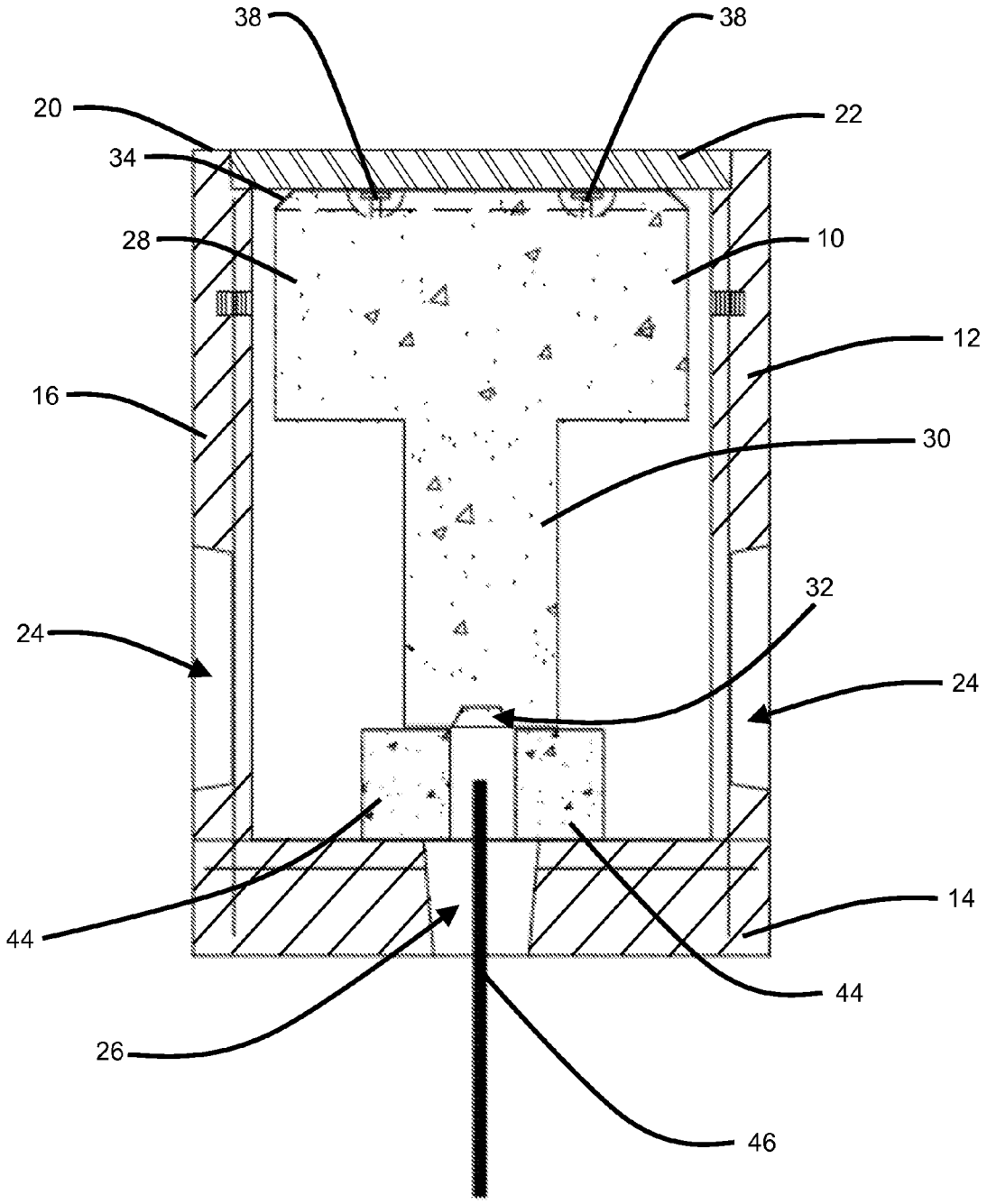
FIG. 3 is a cross-sectional view of a handhole anti-theft insert according to an embodiment of the present invention.
Figure 4:
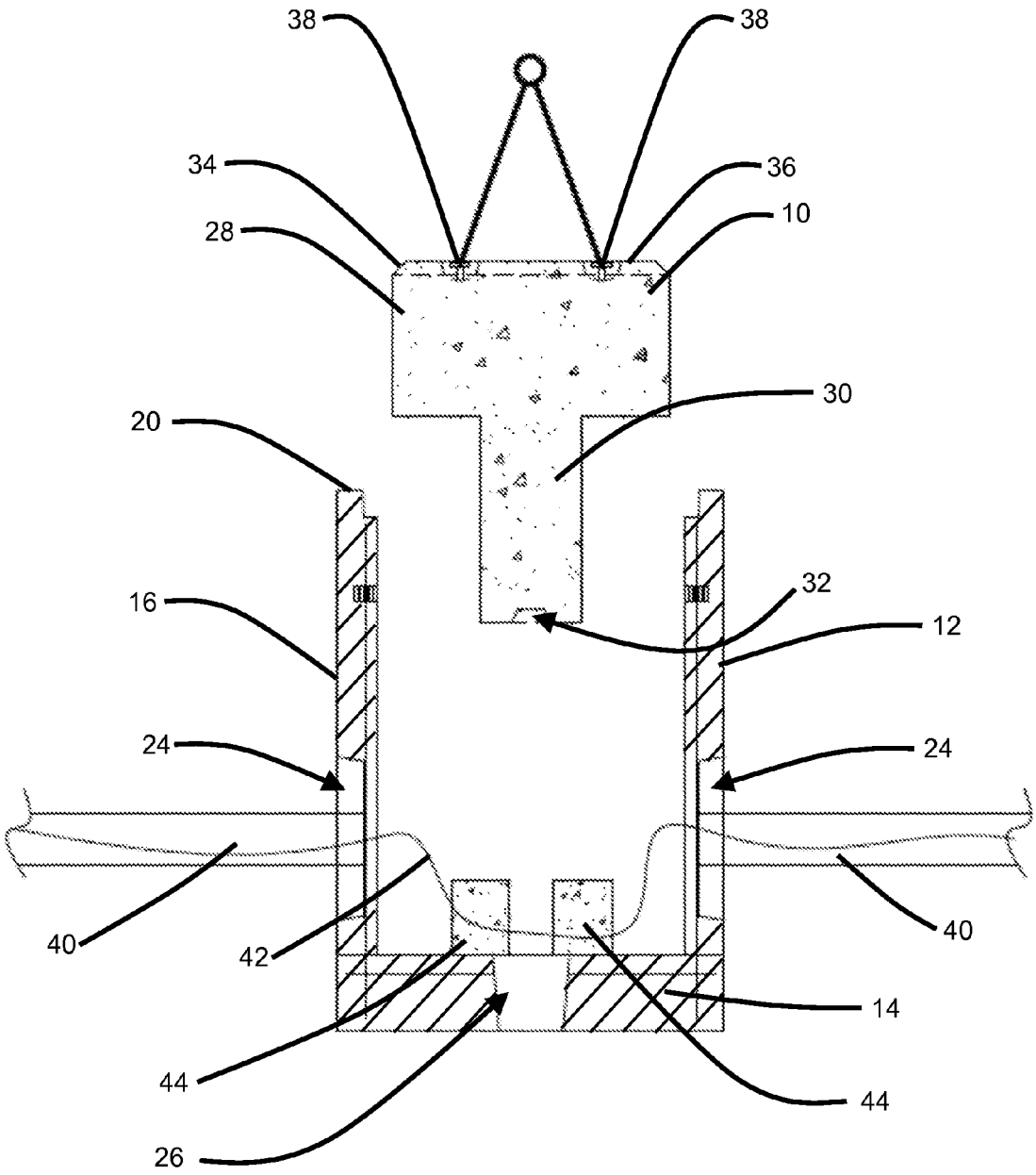
FIG. 4 is a cross-sectional view of a handhole anti-theft insert according to an embodiment of the present invention.
Figure 5:
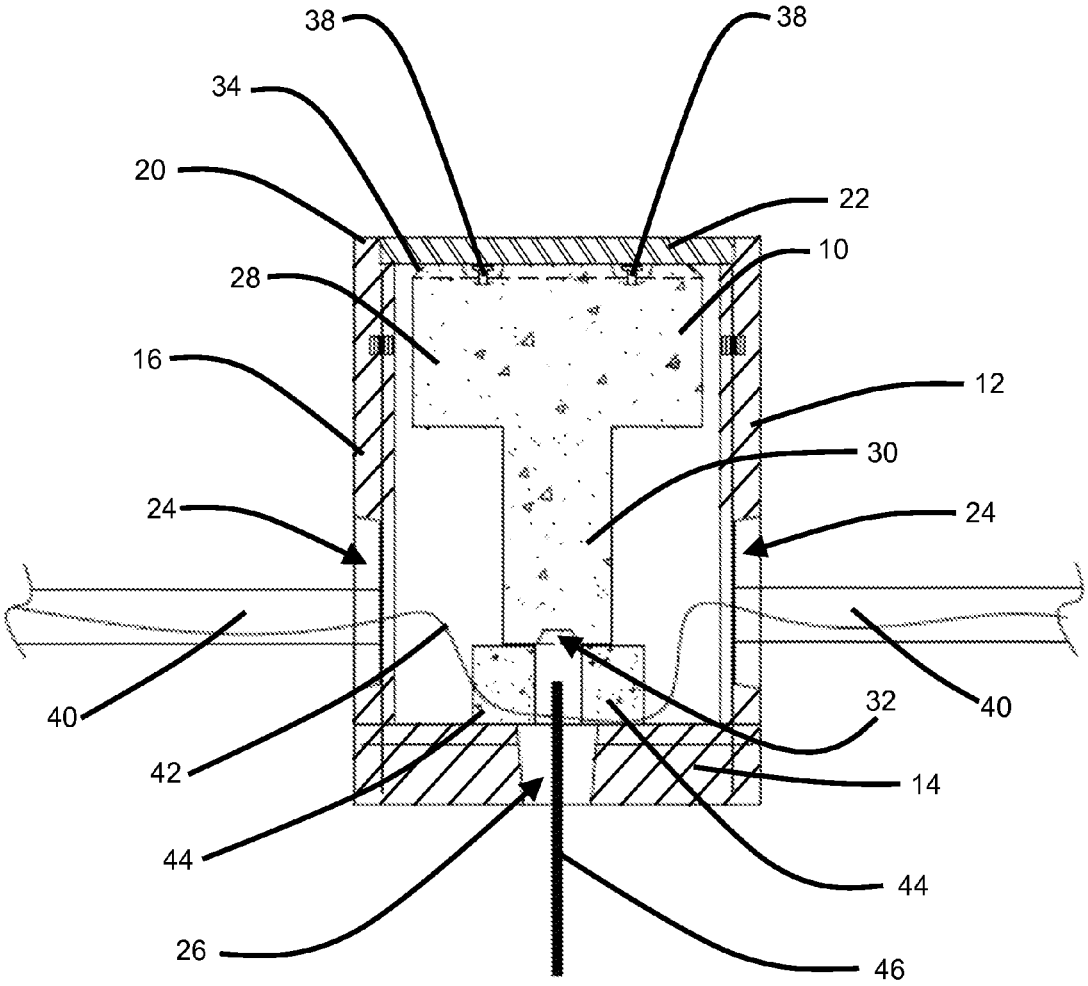
FIG. 5 is a cross-sectional view of a handhole anti-theft insert according to an embodiment of the present invention.
Figure 6A:
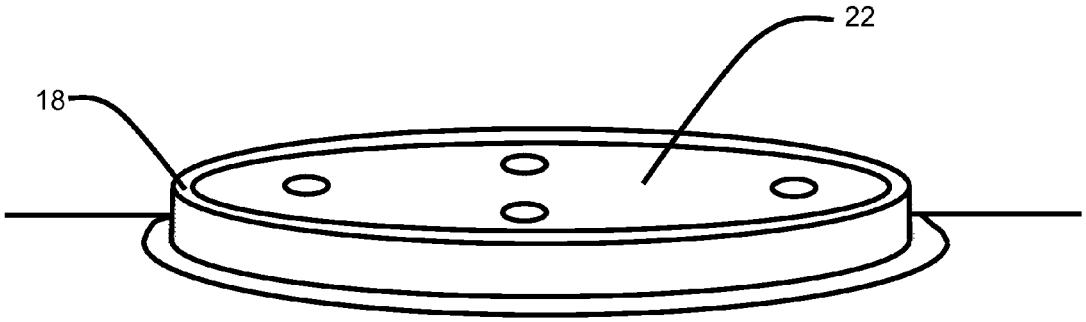
FIG. 6A is a perspective view of a handhole cover according to an embodiment of the present invention.
Figure 6B:
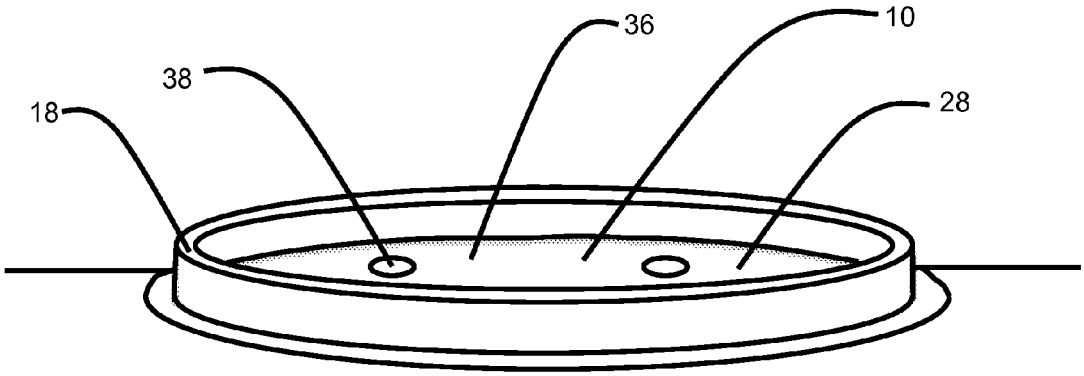
FIG. 6B is a perspective view of a handhole anti-theft insert according to an embodiment of the present invention.
Figure 7:
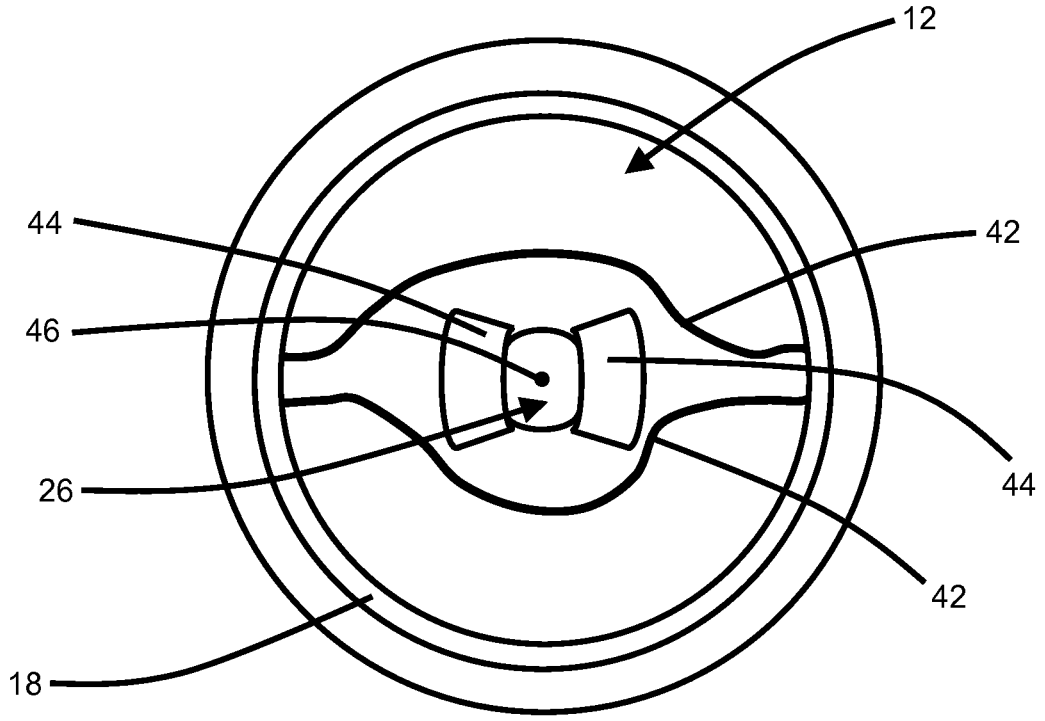
FIG. 7 is a top view of a handhole according to an embodiment of the present invention.
Figure 8:
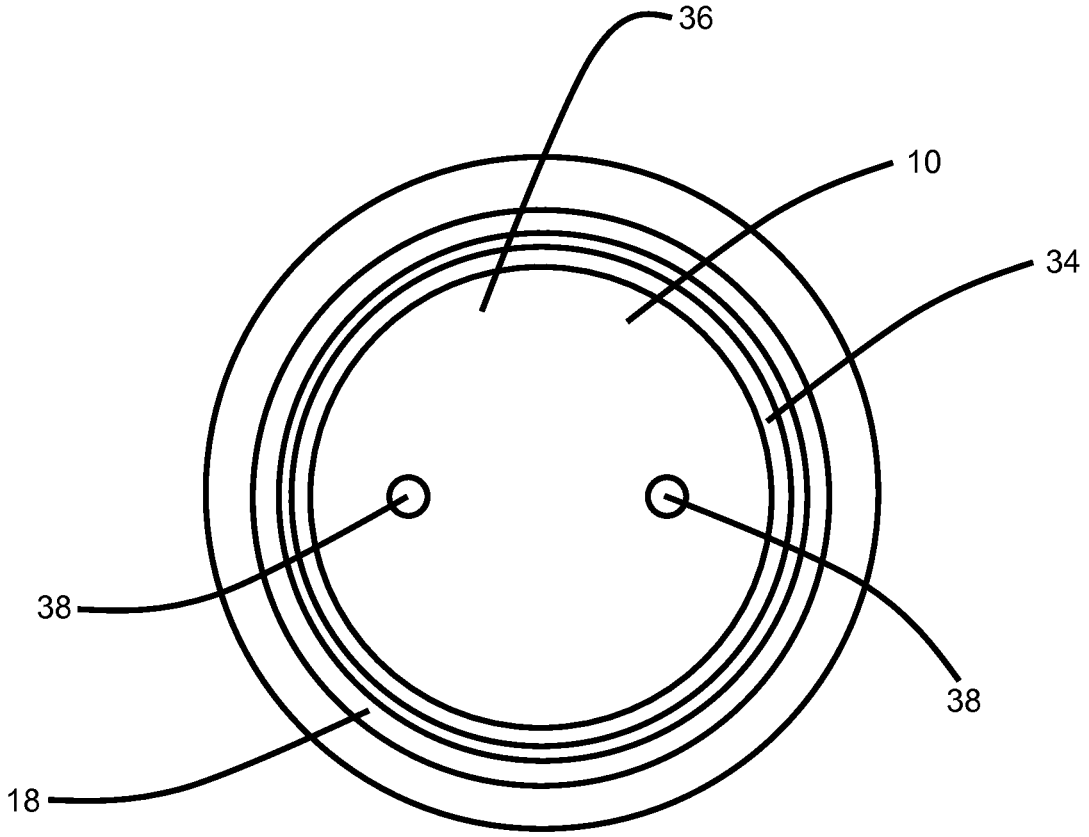
FIG. 8 is a top view of a handhole anti-theft insert shown positioned in a handhole according to an embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

An exemplary handhole anti-theft insert 10 is illustrated in FIGS. 1-8. In this particular embodiment of the present invention, anti-theft insert 10 is shown positioned in a handhole 12 (see e.g. FIGS. 3, 5, 6B and 8). Handhole 12 is comprised of a base member 14 and a sidewall 16 that extends generally vertical from base member 14 and is generally cylindrical in shape. Handhole further includes a frame 18 that is situated near a top 20 of cylindrical sidewall 16, top 20 being positioned at the opposite end of cylindrical sidewall 16 from base member 14. Frame 18 is sized to accept a cover 22 to enclose handhole 12 when cover 22 is situated in frame 18. Base member 14 and sidewall 16 may each include at least one aperture 24 to allow for the passage of pipe, conduit 40, wiring 42 and the like through handhole 12. Base member 14 may also include a sump 26 to allow any water or other liquid that may collect in handhole 12 to drain out of handhole 12. Handhole 12 may additionally include bricks or blocks 44 that raise anti-theft insert 10 off of base member 14 such that a top of anti-theft insert 10 may be positioned just below a bottom of cover 22 when anti-theft insert 10 is seated in handhole 12 and cover 22 is positioned in frame 18. Bricks 44 also provide clearance to a grounding rod 46 such that wiring 42 may be connected to grounding rod 46.

Handhole 12 may be sized to house a number of utilities such as pipe, conduit 40, electrical junction boxes and the like that may be buried underground. While handhole 12 is depicted in the drawings to be generally round in shape, Handhole 12 may be any design such as square, rectangle and the like to facilitate ease of manufacture of the handhole, placement of the handhole in the ground and a suitable housing for underground utilities. Typically handholes are manufactured of concrete or may be fashioned from cinder block and mortar. Frame 18 and cover 22 are generally made from materials such as steel, iron and the like that may be capable of withstanding the constant pounding of motor vehicle traffic travelling over the frame and cover.

A round handhole 12 may be generally twenty-four inches in diameter and sidewall 16 may be thirty-six inches in depth to base member 14. Other common sizes of round handholes may include, but are not limited to, thirty inches and thirty-six inches. The interior of handhole 12 is typically open within base member 14 and sidewall 16 to allow the passage of pipe, conduit 40, wiring 42 and the like through the interior of handhole 12 and apertures 24. Frame 18 and cover 22 enclose handhole 12 to limit the entrance of weather elements into the interior of handhole 12 and prevent unauthorized access to the interior of handhole 12.

While every attempt is made to prevent unauthorized access to the interior of handhole 12, cover 22 may be easily removed from frame 18 to gain access to the interior of handhole 12. If cover 22 is secured to frame 18 be a locking mechanism, frame 18 may be separated from cylindrical sidewall 16 and frame 18 and cover 22 removed to gain unauthorized access to the interior of handhole 12.

Anti-theft insert 10 may be added to the interior of handhole 12 as illustrated in FIGS. 1 and 3-5 to prevent unauthorized access to the interior of handhole 12 even if frame 18 and cover 22 are removed from cylindrical sidewall 16. Anti-theft insert 10 includes a cap 28 and a post member 30. As depicted in the drawings, cap 28 may be sized such that the outer diameter of cap 28 is slightly smaller than the inside diameter of cylindrical sidewall 16. Cap 28 may be sized in this manner to prevent the unauthorized access of person or tool into the interior of handhole 12. Cap 28 may be supported by post member 30 when positioned within the interior of handhole 12. Post member 30 may be sized to provide support for cap 28 while at the same time allowing for the free passage of pipe, conduit 40, wiring 42 and the like through the interior of handhole 12. Post member may include a keyway 32 that may align with sump 26 to provide a drainage path for water or other liquid out of handhole 12. A bottom of post member 30 may be configured to seat against bricks 44. As mentioned above, bricks 44 will provide support to anti-theft insert 10 while at the same time providing clearance for pipe, conduit 40, wiring 42 and access to grounding rod 46.

Cap 28 may include a chamfer 34 that extends the outer diameter of cap 28 near a top surface 36. Chamfer 34 may be included in cap 28 to facilitate the ease of extraction of anti-theft insert 10 when removed from handhole 12. Top surface 36 of cap 28 may also include at least one anchor 38 to secure a cable or rope to anti-theft insert 10. The opposite end of the cable of rope may be attached to a heavy machine such as a crane, end loader, backhoe and the like so that anti-theft insert 10 may be raised or lowered out of or into the interior of handhole 12. Depending on the size and weight of anti-theft insert 10 and the depth of handhole 12, a heavy machine such as those discussed above may be needed to raise, lower and maneuver anti-theft insert 10.

Cap 28 and post member 30 may be manufactured of concrete. Cap 28 and post member 30 may be cast in concrete to facilitate ease of manufacture. Concrete will also provide cap 28 and post member 30 with the weight required to ensure that anti-theft insert 10 cannot easily be removed from handhole 12 without the aid of heavy machinery. In this particular embodiment of the present invention, the weight of anti-theft insert 10 may be generally 200 pounds to 500 pounds. This weight may be adjusted by varying the height and width of cap 28 and post member 30. Although cap 28 and post member 30 have been described as being manufactured from concrete, it is important to note that cap 28 and post member 30 may be manufactured of any material and serve the purpose of preventing the unauthorized access to the interior of handhole 12.

Anchor 38 may be a dowel that is embedded into top surface 36 of cap 28. Top surface 36 may include a void surrounding the dowel such that a hook of the cable may be able to clasp the dowel. Alternatively, anchor 38 may be a threaded insert that is embedded in top surface 36 of cap 28 such that a bolt having an eyelet or hook may be screwed into the inserts to provide an attaching point for the cable. Multiple anchors 38 may be used depending on the need for multiple attaching points to facilitate the ease of maneuverability of anti-theft insert 10. Although a dowel, eyelet and hook bolts have been used in describing the anchoring system of anti-theft insert 10, other typical anchoring means may be used to secure the cable to anti-theft insert 10 for ease of maneuverability of anti-theft insert 10 into and out of handhole 12.

Anti-theft insert 10 may be secured to the cable at anchor 38 and raised by the heavy machine from the ground or delivery truck for introduction into handhole 12. Anti-theft insert 10 may be lowered into the interior of handhole 12 taking care to ensure that any pipe, conduit 40, wiring 42 and the like are free from the path of anti-theft insert 10 as anti-theft insert 10 is lowered into handhole 12. Once anti-theft insert 10 is positioned in handhole 12, the position of anti-theft insert 10 within handhole 12 may be inspected and the cable may be removed upon satisfactory completion of the inspection. With anti-theft insert 10 positioned within handhole 12, cover 22 may be secured on frame 18. Even if frame 18 and cover 22 are removed illegally, anti-theft insert 10 will prevent unauthorized access into the interior of handhole 12.

If access to the interior of handhole 12 is required, cover 22 may be removed from frame 18 and the cable attached to anchor 38. The heavy machine may then remove anti-theft insert 10 to provide access to the interior of handhole 12. Upon completion of work in handhole 12, anti-theft insert 10 can be replaced within the interior of handhole 12 to secure the interior of handhole 12 once again from unauthorized access. Anti-theft insert 10 may be reused, removed and reinserted a number of times without having to replace anti-theft insert 10.

Although anti-theft insert 10 has been described above with the use of a handhole, anti-theft insert 10 may be modified and suited for a manhole. Typically the manhole will extend deeper into the ground than the handhole. Cap 28 and post member 30 may be adjusted such that the height of post member 30 may be increased to extend anti-theft insert 10 the depth of the manhole. The height and width of cap 28 may also be adjusted to increase the weight of anti-theft insert 10 and to provide added stability against the sidewalls of the manhole.

Furthermore, anti-theft insert 10 may be manufactured in any shape to match the shape of the handhole and manhole. Anti-theft insert 10 may be manufactured in rectangular, square or any other shape that may be used to create a handhole or manhole. Also, as stated above, the cross-sectional area of anti-theft insert 10 may be manufactured in any size.

Figure 9A:
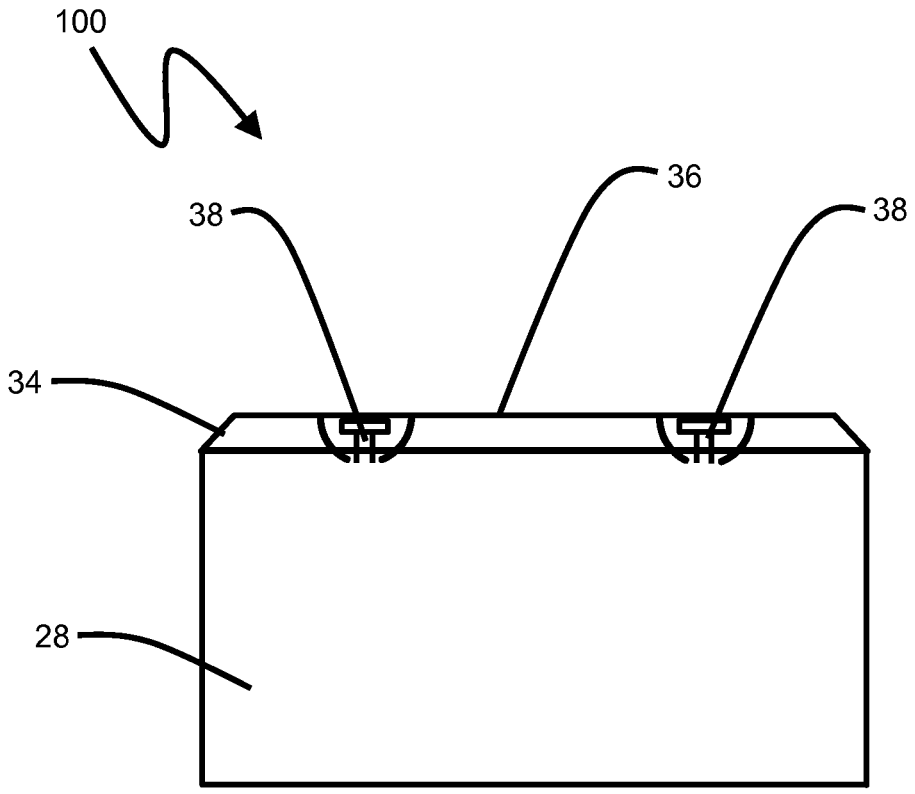
FIG. 9A is a side view of a handhole anti-theft insert according to another embodiment of the present invention.
Figure 9B:
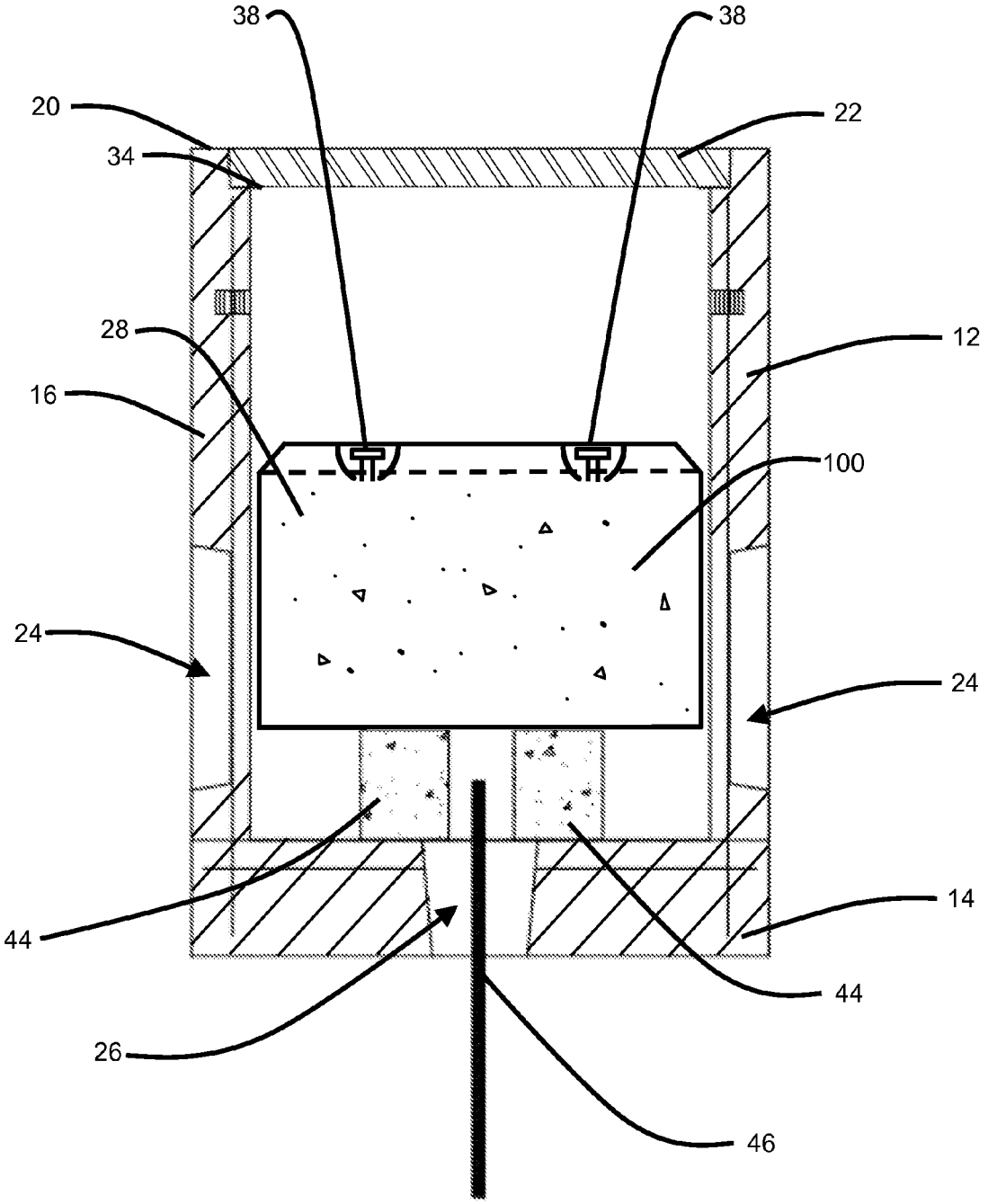
FIG. 9B is a cross-sectional view of a handhole anti-theft insert of FIG. 9A according to an embodiment of the present invention.
Figure 9C:
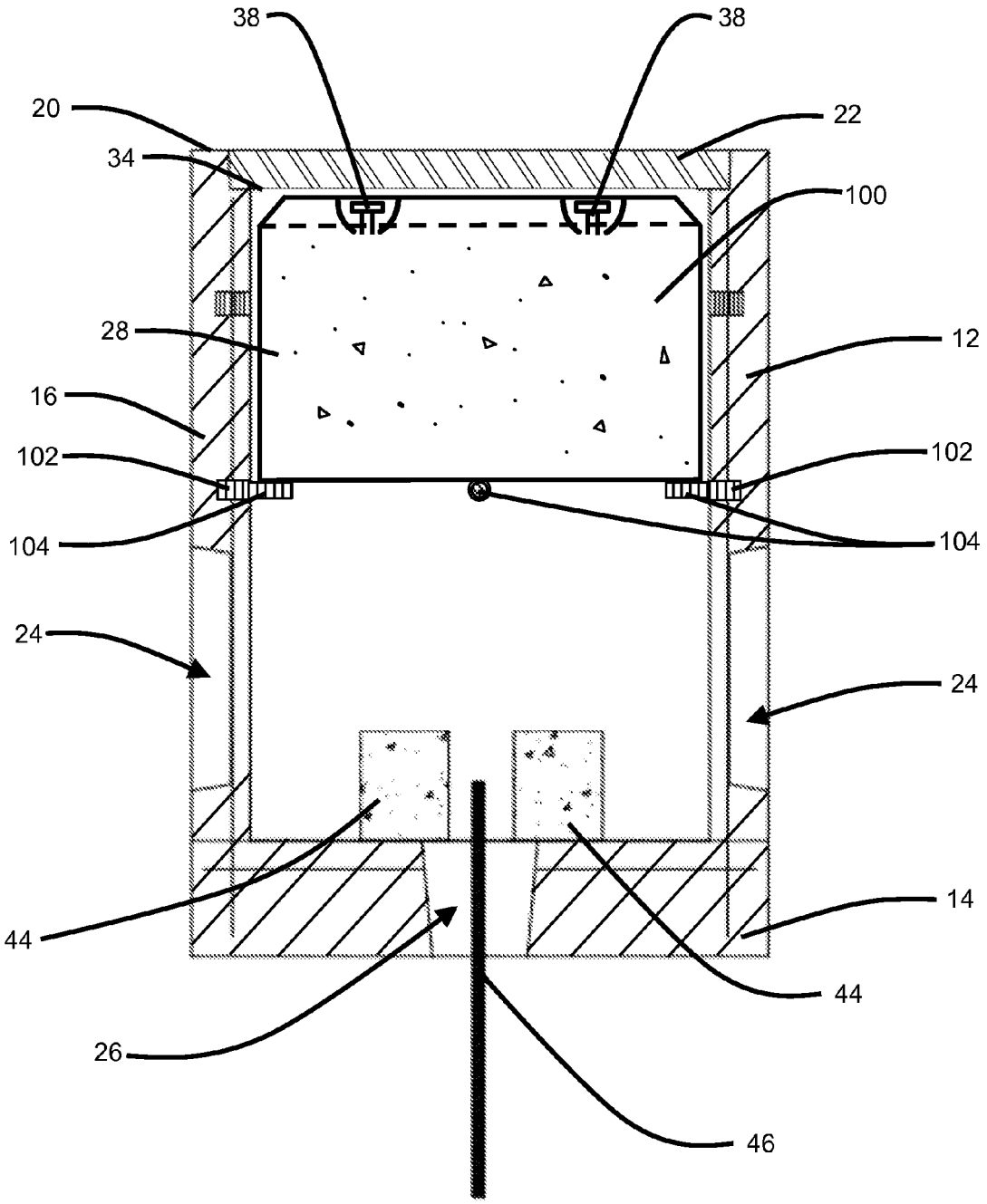
FIG. 9C is a cross-sectional view of a handhole anti-theft insert of FIG. 9A according to an embodiment of the present invention.

FIGS. 9A-9C illustrate anti-theft insert 100 according to another embodiment of the present invention. In this particular embodiment of the present invention, anti-theft insert 100 may include cap 28 and anchors 38. Post member 30 has been removed from anti-theft insert 100 to allow cap 28 to rest directly on bricks 44 as illustrated in FIG. 9B. Anti-theft insert 100 may be used in this manner if handhole 12 is not deep enough to accommodate cap 28 and post member 30 of anti-theft insert 10. Alternatively, anti-theft insert 100 will function equally well in deeper handholes and will aid to prevent removal of anti-theft insert 100 simply due to the fact that cap 28 of insert 100 will not be easily accessible from the surface. For instance, the top of cap 28 of insert 100 may be too deep into handhole 12 and will prevent an individual from reaching cap 28 from the surface and thus prevent unauthorized removal of cap insert 100.

FIG. 9C depicts anti-theft insert 100 supported within handhole 12 by pins 104 that have been secured to cylindrical sidewall 16 by inserts or anchors 102. Pins 104 may extend a distance outward from the interior surface of sidewall 16 into the interior of handhole 12. Anchors 102 may include an internal threaded section that is sized to accept an external threaded section of pins 104. Pins 104 may be screwed into anchors 102 and secured to sidewall 16 such that pins 104 extend outward from sidewall 16 into the interior of handhole 12. With pins 104 positioned in this manner, anti-theft support 100 may be lowered into handhole 12 until a bottom surface of cap 28 engages pins 104. Pins 104 and anchors 102 will support the weight of anti-theft insert 110. A plurality of anchors 102 may be disposed in sidewall 16 to accept pins 104 to provide adequate support for anti-theft insert 100. Alternatively, pins 104 may include a smooth external surface and set within the smooth interior surface of anchors 102. The depth of anchors 102 may be sufficient to accept a section of pins 104 to secure pins 104 to sidewall 16 while extending outward from sidewall 16 into the interior of handhole 12 to support anti-theft insert 100. Pins 104 and anchors may be manufactured of any material such as steel, iron and the like that will provide adequate support for anti-theft insert 100.

Figure 10A:
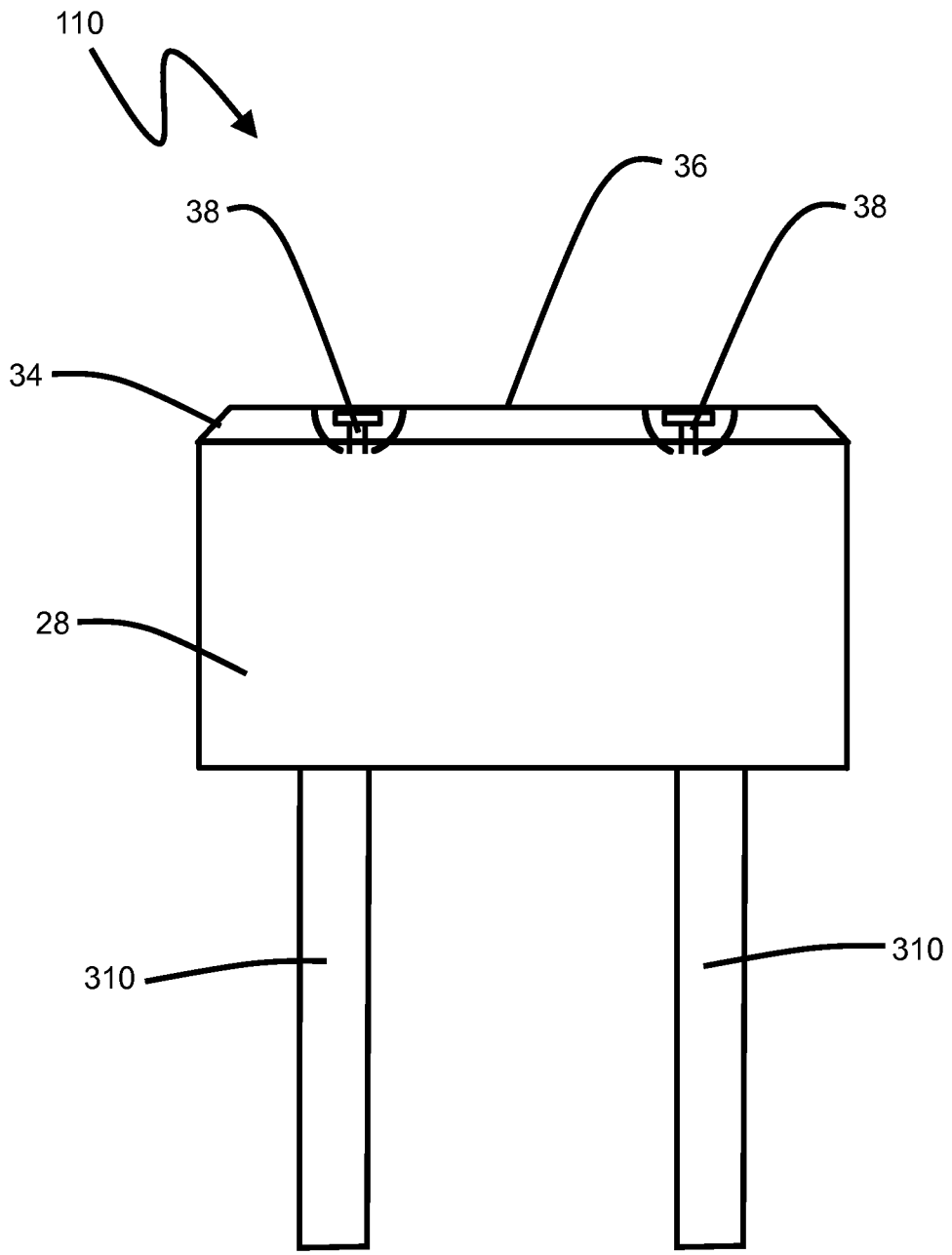
FIG. 10A is a side view of a handhole anti-theft insert according to yet another embodiment of the present invention.
Figure 10B:
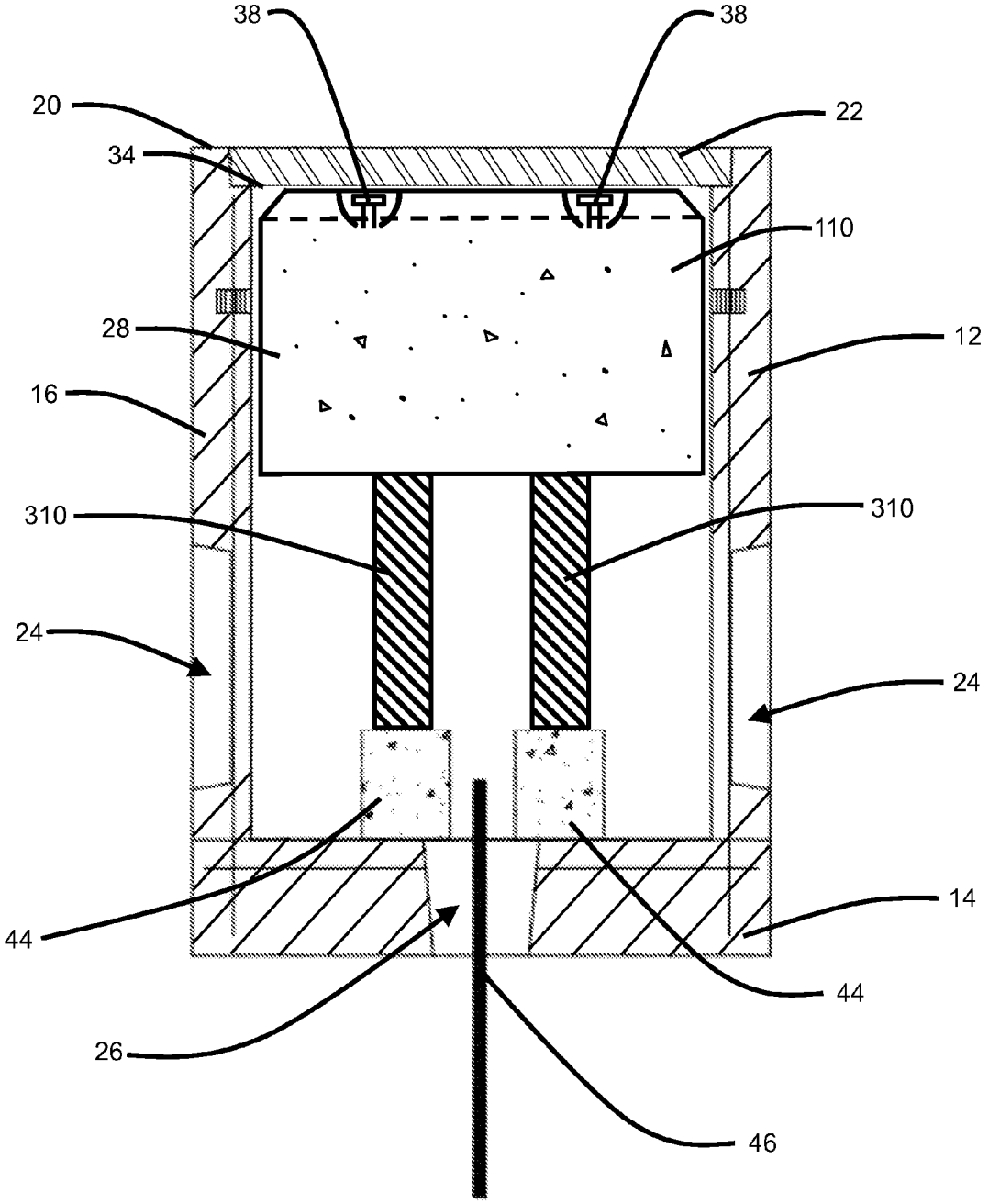
FIG. 10B is a cross-sectional view of a handhole anti-theft insert of FIG. 10A according to an embodiment of the present invention.
Figure 10C:
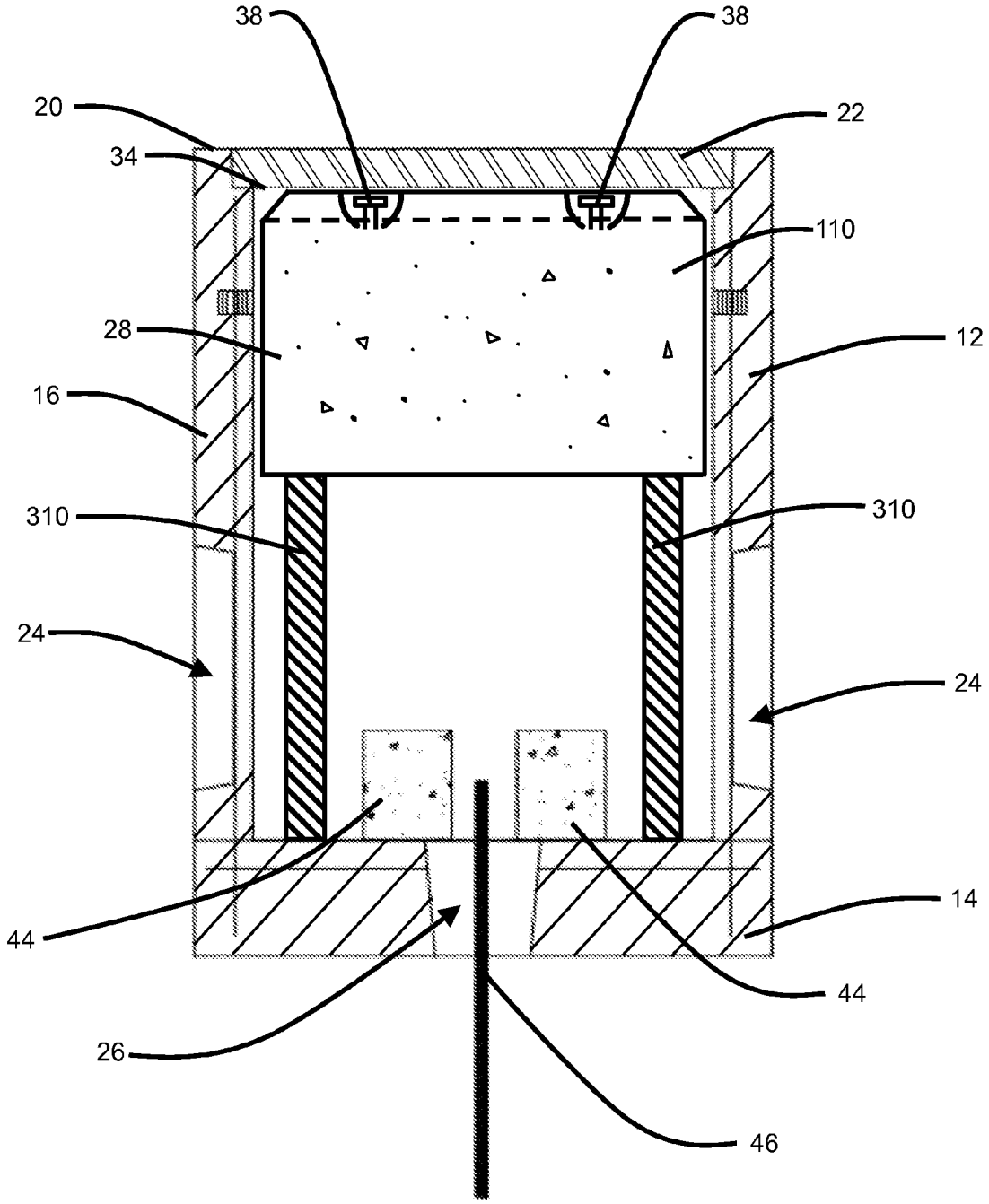
FIG. 10C is a cross-sectional view of a handhole anti-theft insert of FIG. 10A according to an embodiment of the present invention.

FIGS. 10A-10C illustrate anti-theft insert 110 according to yet another embodiment of the present invention. In this particular embodiment of the present invention, anti-theft insert 110 may include cap 28, anchors 38 and multiple posts 310. Posts 310 may be used rather than post member 30 of anti-theft insert 10. Posts 310 may be manufactured of any materials including concrete, steel, iron, wood and the like, that will provide support for cap 28 of anti-theft insert 110. Posts 310 will provide support to cap 28 while allowing for the passage of pipe, conduit, wiring and the like through handhole 12. FIG. 10B depicts posts 310 of insert 110 engaging bricks 44 of handhole 12. Alternatively, posts 310 may be designed to engage base member 14 of handhole 12 as depicted in FIG. 10C. While supporting cap 28, posts 310 will also allow for larger pipe and conduit as well as bundles of wiring to pass through handhole 12 then may be allowed with the use of post member 30. Furthermore, materials such as iron or steel used to manufacture posts 310 may facilitate the ease of any height adjustment on the job site by merely cutting and removing the unneeded post 310 material.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. An anti-theft insert for a handhole or manhole comprising:

a cap, said cap including a chamfer and a top surface;

a post member, said post member including a keyway;

at least one anchor point;

wherein said post member is configured to support said cap;

wherein an outer diameter of said cap is sized to fit within an inner diameter of the handhole or manhole; and wherein the weight of said anti-theft device is of a sufficient amount so as to prevent the manual removal of said anti-theft device from the handhole or manhole.

2. The anti-theft insert as recited in claim 1, wherein the height and width of said cap and said post member are varied to accommodate various sizes of handholes or manholes.

3. The anti-theft insert as recited in claim 1, wherein said cap is circular in shape.

4. The anti-theft insert as recited in claim 1, wherein said cap is rectangular in shape.

5. The anti-theft insert as recited in claim 1, wherein said at least one anchor point is embedded in said top surface of said cap.

6. The anti-theft insert as recited in claim 1, wherein said anti-theft device includes multiple post members.

7. An anti-theft insert for a handhole or manhole comprising:

a cap, said cap including a chamfer and a top surface;

at least one anchor point;

wherein an outer diameter of said cap is sized to fit within an inner diameter of the handhole or manhole; and wherein the weight of said anti-theft device is of a sufficient amount so as to prevent the manual removal of said anti-theft device from the handhole and manhole.

8. The anti-theft insert as recited in claim 7, wherein the height and width of said cap is varied to accommodate various sizes of handholes or manholes.

9. The anti-theft insert as recited in claim 7, wherein said cap is circular in shape.

10. The anti-theft insert as recited in claim 7, wherein said cap is rectangular in shape.

11. The anti-theft insert as recited in claim 7, wherein said at least one anchor point is embedded in said top surface of said cap.

12. The anti-theft insert as recited in claim 7, wherein said anti-theft insert is supported within the handhole or manhole by at least one pin that has been secured to a sidewall of the handhole or manhole.

13. An anti-theft insert capable of preventing unauthorized access to a handhole or manhole and preventing the theft of the internal components of the handhole or manhole, said anti-theft insert comprising:

a cap, said cap including a chamfer and a top surface and a post section;

said post section including a keyway;

at least one anchor point;

wherein said post section is configured to support said cap;

wherein an outer diameter of said cap is sized to fit within an inner diameter of the handhole or manhole; and wherein the weight of said anti-theft device is of a sufficient amount so as to prevent the manual removal of said anti-theft device from the handhole or manhole.

14. The anti-theft insert as recited in claim 13, wherein the height and width of said cap and said post section are varied to accommodate various sizes of handholes or manholes.

15. The anti-theft insert as recited in claim 13, wherein said cap is circular in shape.

16. The anti-theft insert as recited in claim 13, wherein said cap is rectangular in shape.

17. The anti-theft insert as recited in claim 13, wherein said at least one anchor point is embedded in said top surface of said cap.

18. The anti-theft insert as recited in claim 13, wherein said anti-theft device includes multiple post sections.

* * * * *